US009459034B2

(12) United States Patent
Boarman et al.

(10) Patent No.: US 9,459,034 B2
(45) Date of Patent: Oct. 4, 2016

(54) METHOD OF PRODUCING ICE SEGMENTS

(71) Applicant: Whirlpool Corporation, Benton Harbor, MI (US)

(72) Inventors: Patrick J. Boarman, Evansville, IN (US); Brian K. Culley, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 504 days.

(21) Appl. No.: 13/713,154

(22) Filed: Dec. 13, 2012

(65) Prior Publication Data

US 2014/0165610 A1 Jun. 19, 2014

(51) Int. Cl.
*F25C 1/00* (2006.01)
*F25C 1/22* (2006.01)

(52) U.S. Cl.
CPC . *F25C 1/00* (2013.01); *F25C 1/22* (2013.01); *F25C 2500/02* (2013.01)

(58) Field of Classification Search
CPC ..... A23G 9/083; F25C 1/04; F25C 1/22; F25C 1/225
USPC ..... 62/347
See application file for complete search history.

(56) References Cited

U.S. PATENT DOCUMENTS 4,910,974 A * 3/1990 Hara ..... 62/347
5,265,439 A * 11/1993 Hobelsberger ..... 62/356
6,857,277 B2 2/2005 Somura
7,185,508 B2 * 3/2007 Voglewede et al. ..... 62/353
8,677,774 B2 * 3/2014 Yamaguchi et al. ..... 62/340
2005/0219812 A1 * 10/2005 Strobel ..... 361/687

FOREIGN PATENT DOCUMENTS

| | | | |
|---|---|---|---|
| GB | 2139337 | A | 11/1984 |
| JP | 60141239 | A | 7/1985 |
| JP | 2031649 | A | 2/1990 |
| JP | 4015069 | A | 1/1992 |
| JP | 10253212 | A | 9/1998 |
| KR | 2001109256 | A | 12/2001 |
| KR | 2011037609 | A | 4/2011 |
| TW | 424878 | U | 3/2001 |

* cited by examiner

*Primary Examiner* — Cassey D Bauer

(57) ABSTRACT

A method of making an ice structure comprising the steps of: providing a mold with at least two mold portions where the at least two mold portions come together to form a cavity that defines a shape of an ice structure; placing the at least two mold portions in thermal communication with at least one cooling source; chilling the at least two mold portions using the at least one cooling source; orienting the at least two mold portions in spaced apart relation; delivering a flow of water such that the flow of water passes along the surface of the at least two mold portions with the mold segments such that water flows (by capillary/wicking action) over the mold segment and forms an ice structure segment; ceasing the flow of water when the ice structure segments are formed; and fusing the ice structure segments together to form the ice structure.

20 Claims, 6 Drawing Sheets

METHOD OF PRODUCING ICE SEGMENTS

SUMMARY OF THE INVENTION

The present disclosure includes a method of making an ice structure comprising the steps of: providing a mold with at least two mold portions comprising a first portion and a second portion wherein the at least two mold portions come together to form a cavity that defines a shape of an ice structure and each of the at least two mold portions have a mold segment on a surface of the at least two mold portions wherein each mold segment has a volume and wherein the at least two mold portions have a surface that does not contain the mold segment; placing the at least two mold portions in thermal communication with at least one cooling source; chilling the at least two mold portions using the at least one cooling source; orienting the at least two mold portions in spaced apart relation; delivering a flow of water such that the flow of water passes along the surface of the at least two mold portions with the mold segments such that water flows over the mold segment and forms an ice structure segment; ceasing the flow of water when the mold segments contain the formed ice structure segment; and bringing the ice structure segments into contact to fuse them together to form the ice structure.

The present disclosure further includes a method of making a spherically shaped ice structure comprising the steps of: providing a mold having a first mold portion and a second mold portion wherein the first mold portion comprises a hemispherically-shaped cavity along a first surface of the first mold portion and an ice structure forming cavity-free surface and the second mold portion comprises a hemispherically-shaped cavity along a first surface of the second mold portion and an ice structure forming cavity-free surface; placing the two mold portions in thermal communication with at least one cooling source; chilling the first mold portion and the second mold portion to form a chilled first mold portion and a chilled second mold portion using the at least one cooling source; orienting the at least two mold portions in spaced apart relation; delivering a flow of water over a surface of the chilled first mold portion that has a hemispherically-shaped cavity and over the surface of the second chilled mold portion that has a hemispherically-shaped cavity such that the flow of water passes along the surface of the first chilled mold portion having a hemispherically-shaped mold cavity and along the surface of the second chilled mold portion having a hemispherically-shaped mold cavity wicks along the contour of the mold surfaces having a hemispherically-shaped cavity and into the hemispherically-shaped mold cavity of the chilled first and second mold portions thereby gradually forming a hemispherically-shaped ice structure segment within the hemispherical mold section of both the first mold portion and the second mold portion; and fusing the hemispherically-shaped ice structure segments thereby forming the spherically shaped ice structure.

Yet another aspect of the present disclosure is generally directed to a method comprising the steps of: providing a mold having a first mold portion and a second mold portion wherein the first mold portion comprises a shaped cavity along a first surface of the first mold portion and an opposing ice structure forming cavity-free surface and the second mold portion comprises a mold shaped cavity along a first surface of the second mold portion and an opposing ice structure forming cavity-free surface; placing the first mold portion in thermal communication with a thermoelectric cooling source and the second mold portion in thermal communication with a thermoelectric cooling source; chilling the first mold portion and the second mold portion using the first and second thermoelectric cooling sources to form a chilled first mold portion and a chilled second mold portion; orienting the at least two mold portions in spaced apart relation such that the shaped cavity of the first portion and the shaped cavity of the second portion are each at least substantially vertically oriented; delivering a flow of water over a surface of the chilled first mold portion that has a shaped cavity and over the surface of the second chilled mold portion that has a shaped cavity such that the flow of water passes along the surface of the first chilled mold portion having a shaped mold cavity and along the surface of the second chilled mold portion having a shaped mold cavity wicks along the contour of the mold surfaces having a shaped cavity and into the shaped mold cavity of the chilled first and second mold portions thereby gradually forming a shaped ice structure segment within the mold section of both the first mold portion and the second mold portion; ceasing the flow of water when the first mold portion and the second mold portion contain the formed hemispherically-shaped ice structure segments; fusing the shaped ice structure segments together by bringing them together and applying heat thereby forming a shaped ice structure; and ejecting the spherically shaped ice structure from the mold.

Any of the above aspects of the present disclosure may also utilize an ice melting surface to perform an ice melting/smoothing step. The ice melting surface may be removably positioned such that the ice melting surface will melt and typically flatten the surface of the ice segments that will be bonded or fused together, typically when the ice segments are hemispherically-shaped, what will be the equatorial surface of the spherically shaped ice structure.

These and other features, advantages, and objects of the present invention will be further understood and appreciated by those skilled in the art by reference to the following specification, claims, and appended drawings.

DETAILED DESCRIPTION

Figure 1:
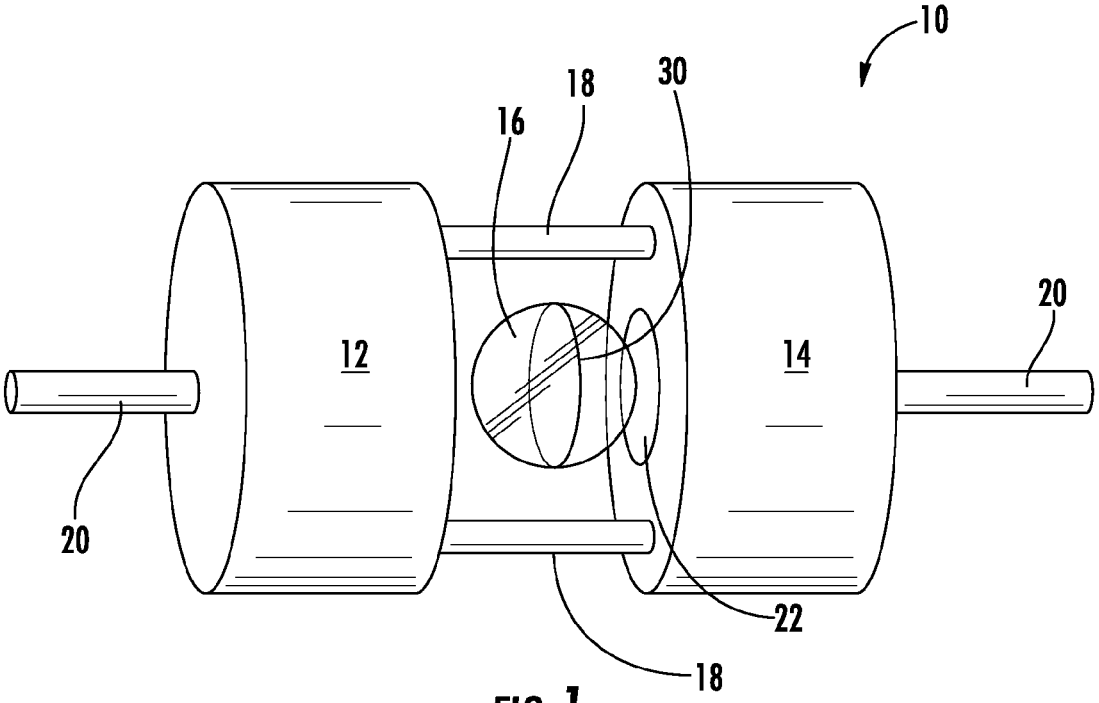
FIG. 1 is perspective view of a clear ice sphere released from a mold according to an aspect of the present disclosure.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

It will be understood by one having ordinary skill in the art that construction of the described invention and other components is not limited to any specific material. Other exemplary embodiments of the invention disclosed herein may be formed from a wide variety of materials, unless described otherwise herein. In this specification and the amended claims, the singular forms "a," "an," and "the" include plural reference unless the context clearly dictates otherwise.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The present disclosure is generally directed toward a method of making a clear ice structure or structures and devices for carrying out the methods. The processes of the present disclosure may utilize a clear ice forming device 10 with mold portions, which may be two or more mold portions, but are typically two mold portions (halves) 12, 14 as shown in the figures to form a final clear ice structure(s) 16, typically a spherically-shaped clear ice structure. The mold portions are typically a highly thermally conductive metal material and may optionally be coated such that the mold segments/cavities are covered with an ice-phobic material such as a silicon to facilitate release of the final clear ice structures from the mold. The device may also form structures of other shapes depending on the configuration of the mold portions. Conceivably, three or more mold portions may form ice structure portions that combine to form the final clear ice structures.

As shown in FIG. 1, the mold may form one clear ice structure, but the mold may be constructed to create any number of clear ice structures, including a plurality of clear ice structures, simultaneously or substantially simultaneously. FIG. 1 shows that the mold halves 12, 14 are interconnected and supported and movable along interconnecting support rods 18 that move, typically by sliding within apertures within each mold half. Drive rods 20 may be used to move the mold halves between an engaged position and a disengaged position. The drive rods are typically operably connected to a motivating device to provide the moving forces to the drive rods and thereby the mold portions. Alternatively, the mold halves conceivably could be hingedly connected.

Figure 2:
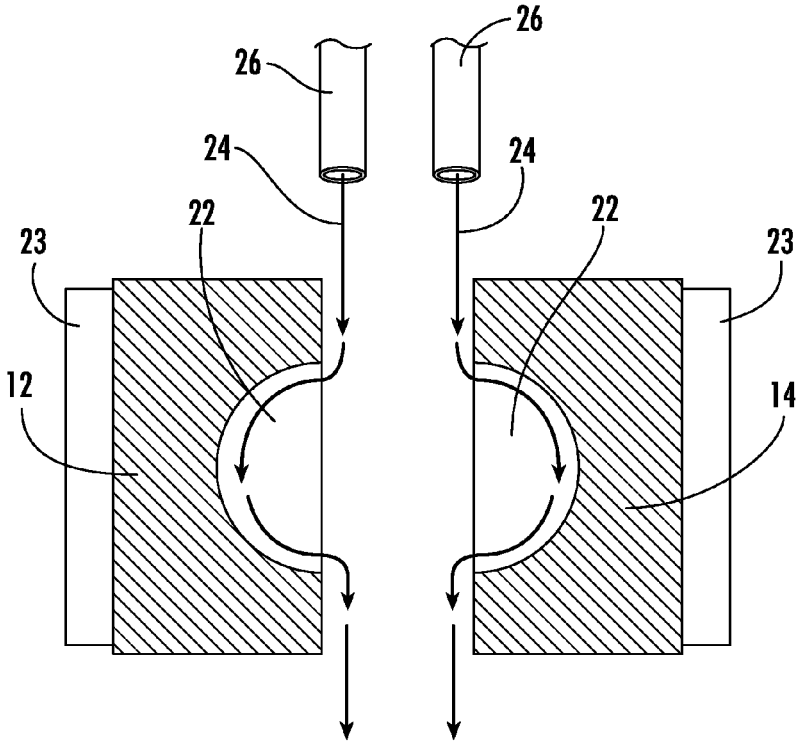
FIG. 2 is a cross-sectional view of the mold in a preliminary stage as the ice forms within the ice mold cavities of two mold portions.
Figure 3:
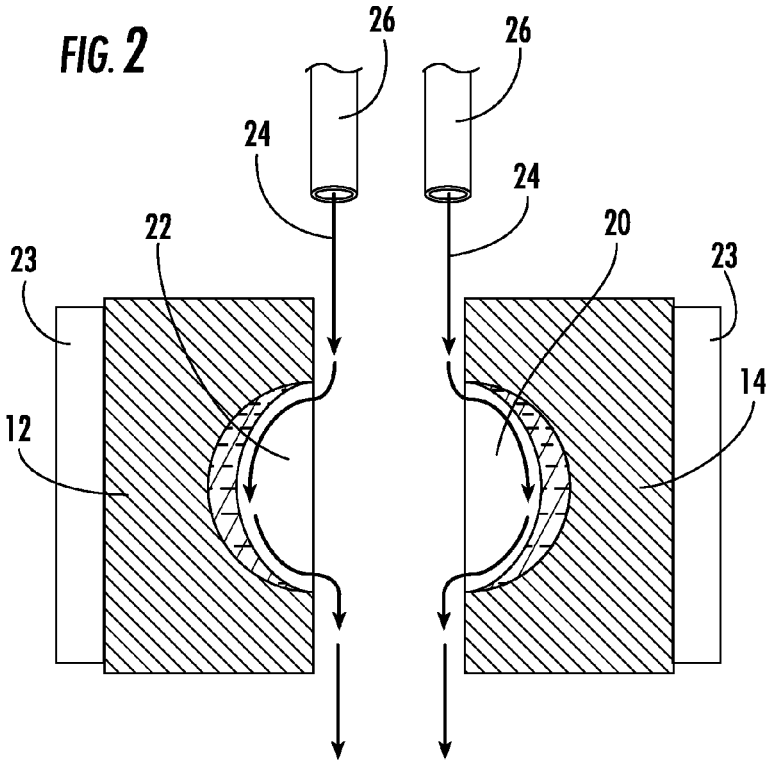
FIG. 3 is a cross-sectional view of the mold in an intermediate ice forming stage within the ice mold cavities of two mold portions.
Figure 4:
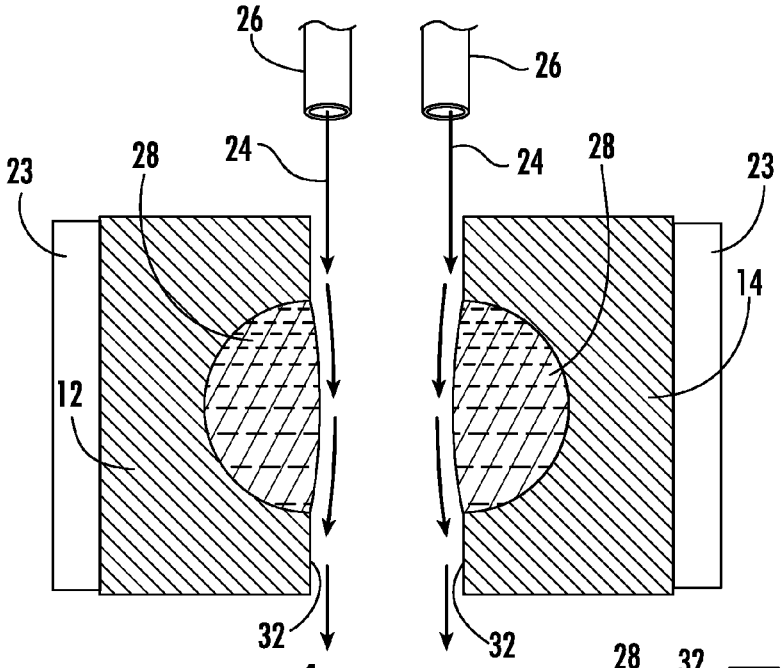
FIG. 4 is a cross-sectional view of the mold in a final ice forming stage within the ice mold cavities.
Figure 5:
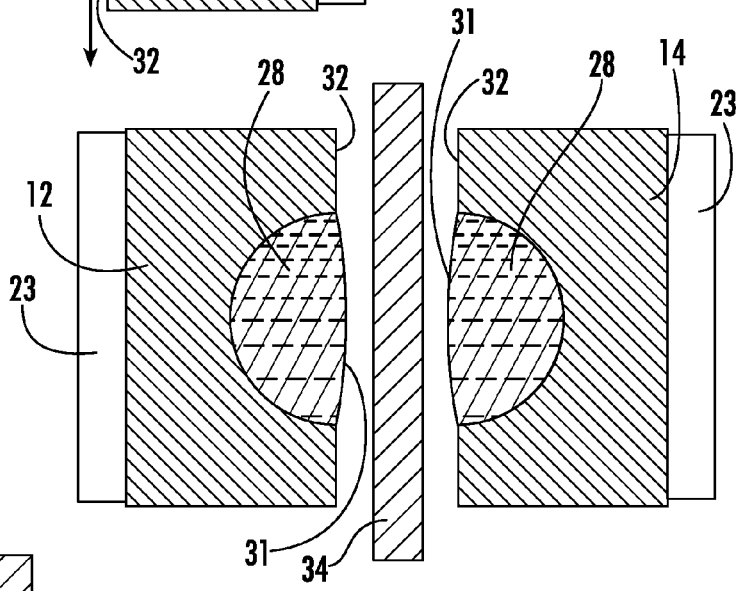
FIG. 5 is a view of the mold portions being positioned to engage the optional ice melting/smoothing device prior to fusing.
Figure 6:
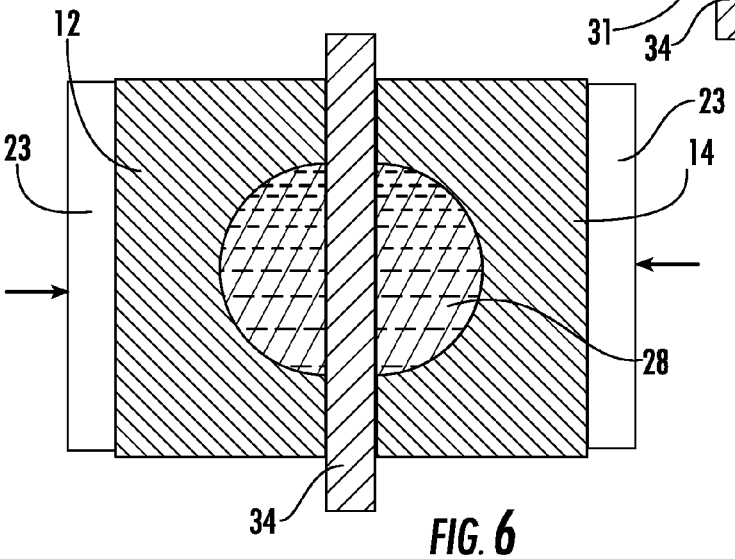
FIG. 6 is a view of the mold portion engaging the optional ice melting/smoothing device prior to fusing.
Figure 7:
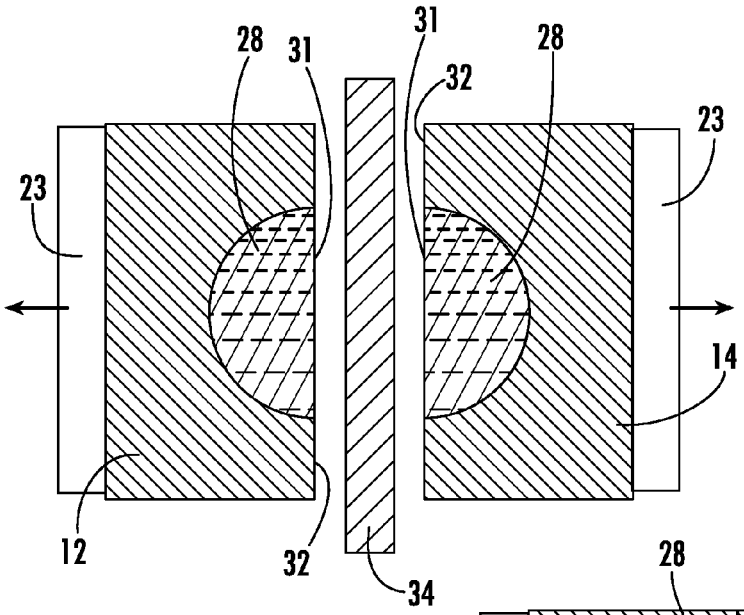
FIG. 7 is a cross-sectional view of the two mold portion with flattened surfaces being disengaged with the optional ice melting/smoothing device.
Figure 8:
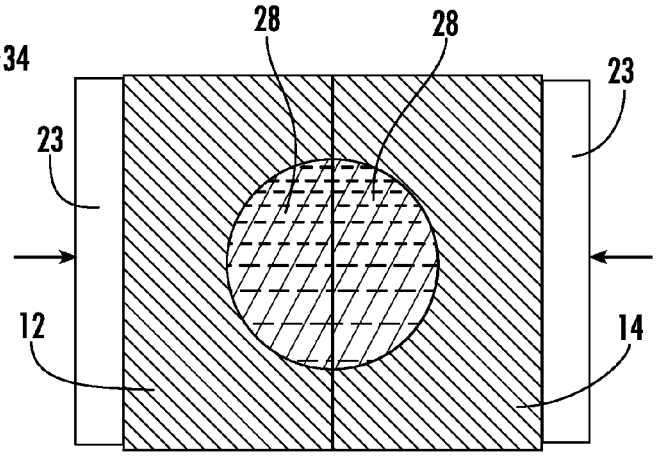
FIG. 8 is a cross-sectional view of the two mold portions engaged to one another and being fused together to form a clear spherically-shaped ice structure.
Figure 9:
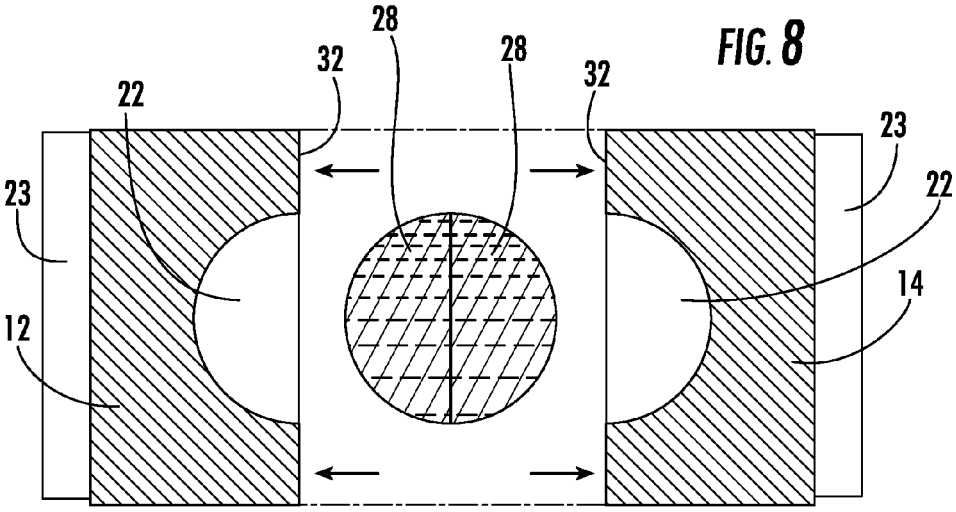
FIG. 9 is a cross-sectional view of the present disclosure where the clear spherically-shaped ice structure is released from within a closed or substantially closed ice mold.

The mold halves are usually positioned in an at least substantially vertical or a vertical position as shown in the Figures. The mold segments/cavities 22 are cooled/chilled by placing the mold halves in thermal communication with at least one cooling source that transmits cooling to the mold half. The cooling source typically abuts the mold portions, typically along the surface without the ice forming cavity. The cooling source 23 is typically a thermoelectric cooling device but can be an evaporator, a thermoelectric source, a secondary cooling loop and/or air below freezing temperature. As shown in FIGS. 2-4, two ice structure portions (in the case shown, halves 26*a*, 26*b*) are formed by delivering a flow of water 24 from at least one, but typically a water source 26 for each mold portion from above the mold portion in such a manner that the water flows along the surface of the at least two mold portions with the mold segments/cavities 22 and wicks (using capillary action) into the cavity 22 of the mold segment where successive layers of ice are formed as shown in FIGS. 3-4. Ultimately, when two mold halves are used, the mold segments form ice structure segments that may be combined to form the final ice structure. Once the ice structure segments are formed within the cavities of the typically the two mold segments, 12, 14 form two substantially hemispherically-shaped ice structure portions 28. The two substantially hemispherically-shaped ice structure portions 28 may be combined by bringing the mold portions together to engage the at least substantially hemispherically-shaped ice portions 28 with one another and form the final formed spherically-shaped ice structure 16, which will have one visible section where the portions are joined. In the case of the two at least substantially hemispherically-shaped ice portions, they come together to form a final clear ice spherically-shaped ice structure 16 with a single visible line at the equatorial plane 30 of the final clear ice spherically-shaped ice structure 16.

The formed ice structures portions 28 may optionally be further processed prior to being fused together to form the final ice structure or structures 16. As shown in FIGS. 5-9, the formed ice structure portions 28 may have an exterior, merging surface 31 of the portions 28 that is not smooth due to the manner of forming the formed ice structure portions 28. When ice extends beyond the surface 32 of the mold portions 12, 14, the mold portions may be placed into contact with a metal surface, which may be a heated metal surface, or another surface 34 that melts excess ice and flattens the surface see FIG. 7). Thereafter, the now smooth and wet surfaces are more easily merged together to form the clear ice sphere. Lastly, the clear ice spheres (structures) are ejected from the mold. Additionally, the surface 34 may have a raised and shaped portion that melts a center portion of the ice structure portions along merging surface 31 to form a hollow, three-dimensional shape within the final clear ice structures. Conceivably, before the mold portions are fused, the mold portions may be rotated such that at least one of the mold portions are horizontally oriented and a filling material, a liquid such as a colorant and/or flavorant for example or a solid material inserted into the hollowed section of the ice structure portion. The inserted material may be frozen wither before or after the mold portions come together and the final clear ice structure is fused and formed. In this case, the center may be shaped for a season (Christmas tree for Christmas, or a heart for Valentine's Day, for example) and filed with colored liquid such as green or red (Christmas), or pink (Valentine's Day). The added liquid might be a liquor or other alcoholic liquid or non-alcoholic liquid.

Figure 10:
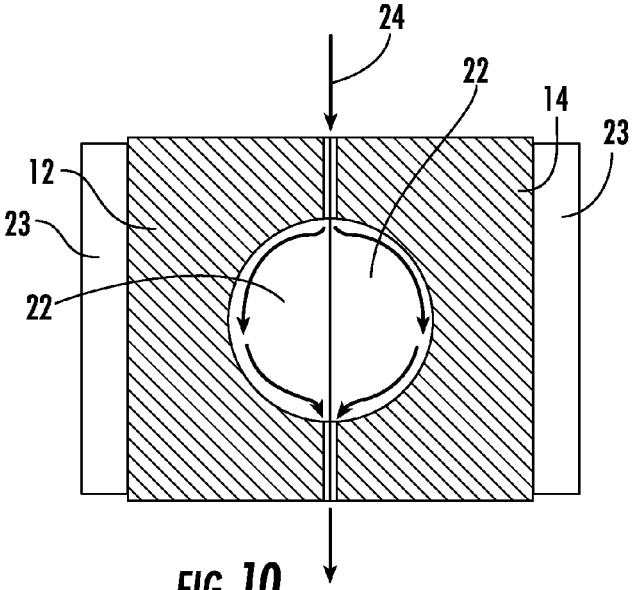
FIG. 10 is a cross-sectional view of another aspect of the present disclosure at its initial stage where the clear spherically-shaped ice structure is formed with the mold closed or substantially closed during the process.
Figure 11:
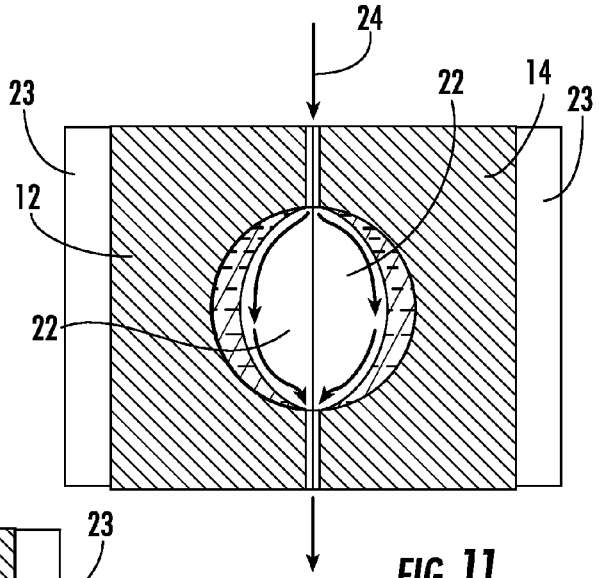
FIG. 11 is a cross-sectional view of another aspect of the present disclosure at its initial stage where the clear spherically-shaped ice structure is formed with the mold closed or substantially closed during the process.
Figure 12:
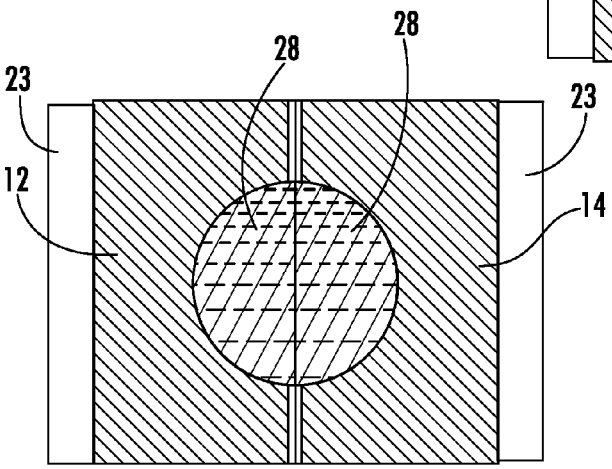
FIG. 12 is a cross-sectional view of another aspect of the present disclosure at its initial stage where the clear spherically-shaped ice structure is formed with the mold closed or substantially closed during the process.
Figure 13:
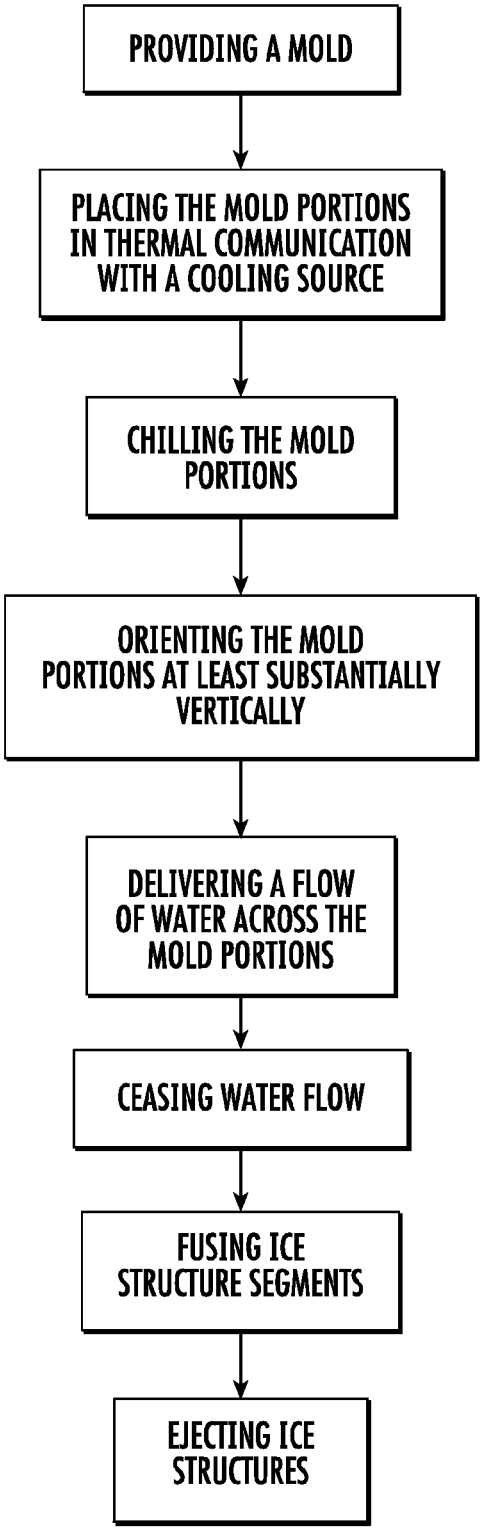
FIG. 13 is a flowchart of various steps that may be used according to an aspect of the present disclosure.

As shown in FIGS. 10-12, Applicants presently believe that clear ice structures may also be formed with the mold portions in a closed or at least substantially closed position throughout the production of the clear ice structure(s). The water is allowed to flow and move by capillary action across the chilled surface of the mold portions. The water that does not freeze proceeds out of the mold portions at a water outlet location 36. This may only produce hollow spheres and may not form solid clear ice spherically-shaped ice structures as would be formed in the process previously described herein.

The invention claimed is:

1. A method of making an ice structure comprising the steps of:

providing a mold with at least two mold portions comprising a first portion and a second portion wherein the at least two mold portions come together to form a cavity that defines a shape of an ice structure and each of the at least two mold portions have a mold segment on a surface of the at least two mold portions, wherein two supporting rods extend between the surfaces of the at least two mold portions, the at least two mold portions being slidable thereon, and further wherein each mold segment has a volume and wherein the at least two mold portions have a surface that does not contain the mold segment and has a drive rod extending therefrom;

placing the at least two mold portions in thermal communication with at least one cooling source;

chilling the at least two mold portions using the at least one cooling source;

orienting the at least two mold portions in spaced apart relation;

delivering a flow of water such that the flow of water passes along the surface of the at least two mold portions with the mold segments such that water flows over the mold segment and forms an ice structure segment;

ceasing the flow of water when the mold segments contain the formed ice structure segment; and bringing the ice structure segments into contact to fuse them together to form the ice structure.

2. The method of claim 1, wherein the surface that does not contain the mold segment is in thermal contact with the cooling source.

3. The method of claim 2, wherein the cooling source comprises a cooling source chosen from the group consisting of: an evaporator, a thermoelectric source, a secondary cooling loop and air below freezing temperature.

4. The method of claim 3, wherein the at least two mold portions are two mold portions that each have a mold segment that is one hemisphere and each form hemispherically-shaped ice structure segments that are brought into contact and fused together in the process to form a spherical ice structure.

5. The method of claim 1, wherein the ice structure is a clear spherical ice structure having an equatorial line where the hemispherically-shaped ice structure segments are merged together to form the spherical ice structure.

6. The method of claim 1, wherein the step of orienting the at least two mold portions comprises: orienting the at least two mold portions such that the at least two mold segments of the at least two mold portions are at least substantially vertically oriented and the step of delivering a flow of water comprises delivering a flow of water from above the mold segments such that the water flows over the mold segment and forms an ice structure segment using capillary action of the water to cause the water to move across the mold cavity segment from the top to the bottom and over at least a substantial portion of the mold cavity segment.

7. The method of claim 1, wherein a first portion of the water moving across the mold cavity segment is frozen and a second portion leaves the mold portions.

8. The method of claim 1, wherein the step of fusing the ice structure segments further comprises heating the ice structure segments.

9. The method of claim 1, wherein the at least one cooling source is a single cooling source that chills the at least two mold portions.

10. The method of claim 1, wherein the at least one cooling source is two cooling sources with a first cooling source in thermal engagement with a first mold portion and a second cooling source in thermal engagement with a second mold portion.

11. The method of claim 10, wherein the at least two mold portions consist of the first mold portion and the second mold portion.

12. The method of claim 11, wherein the first mold portion and the second mold portion consist essentially of at least one metallic material.

13. The method of claim 12, wherein the first mold portion and the second mold portion have an ice-phobic coating applied to the mold cavity segments and the method further comprises the step of ejecting the fused ice structure from at least one of the mold portions.

14. The method of claim 1, wherein the step of bringing the ice structure segments into contact to fuse them together to form the ice structure uses a motorized drive mechanism to move at least one of the at least two mold portions such that the ice structure segments come into contact with one another to form the ice structure.

15. The method of claim 14, wherein the ice structure is a clear spherical structure with a visible equatorial line.

16. The method of claim 1, wherein the at least two mold portions are two mold portions and the step of delivering a flow of water comprises continuously flowing water over the surface of the at least two mold portions with the mold segments such that water flows over the mold segment until the ice structure segment in the mold portions are formed.

17. A method of making a spherically shaped ice structure comprising the steps of:

providing a mold having a first mold portion and a second mold portion wherein the first mold portion comprises a hemispherically-shaped cavity along a first surface of the first mold portion and an ice structure forming cavity-free surface and the second mold portion comprises a hemispherically-shaped cavity along a first surface of the second mold portion and an ice structure forming cavity-free surface, wherein a supporting rod extends between the first surfaces of the first and second mold portions;

placing the two mold portions in thermal communication with at least one cooling source;

chilling the first mold portion and the second mold portion to form a chilled first mold portion and a chilled second mold portion using the at least one cooling source;

orienting the at least two mold portions in spaced apart relation;

delivering a flow of water over a surface of the chilled first mold portion that has a hemispherically-shaped cavity and over the surface of the second chilled mold portion that has a hemispherically-shaped cavity such that the flow of water passes along the surface of the first chilled mold portion having a hemispherically-shaped mold cavity and along the surface of the second chilled mold portion having a hemispherically-shaped mold cavity wicks along the contour of the mold surfaces having a hemispherically-shaped cavity and into the hemispherically-shaped mold cavity of the chilled first and second mold portions thereby gradually forming a hemispherically-shaped ice structure segment within the hemispherical mold section of both the first mold portion and the second mold portion;

ceasing the flow of water when the first mold portion and the second mold portion contain the formed hemispherically-shaped ice structure segments; and fusing the hemispherically-shaped ice structure segments thereby forming the spherically shaped ice structure.

18. The method of claim 17, wherein the at least one cooling source comprises a first cooling source that abuts a surface of the first mold portion other than the surface having a hemispherically-shaped cavity and a second cooling source that abuts a surface of the second mold portion other than the surface having a hemispherically-shaped cavity and wherein the method further comprises the step of:

ejecting the spherically shaped ice structure from the mold.

19. The method of claim 18, wherein the first cooling source and the second cooling source are each a thermoelectric cooling source.

20. A method comprising the steps of:

providing a mold having a first mold portion and a second mold portion wherein the first mold portion comprises a shaped cavity along a first surface of the first mold portion and an opposing ice structure forming cavity-free surface and the second mold portion comprises a mold shaped cavity along a first surface of the second mold portion and an opposing ice structure forming cavity-free surface, wherein a supporting rod extends between the first surfaces of the first and second mold portions;

placing the first mold portion in thermal communication with a first thermoelectric cooling source and the second mold portion in thermal communication with a second thermoelectric cooling source;

chilling the first mold portion and the second mold portion using the first and second thermoelectric cooling sources to form a chilled first mold portion and a chilled second mold portion;

orienting the at least two mold portions in spaced apart relation such that the shaped cavity of the first portion and the shaped cavity of the second portion are each at least substantially vertically oriented;

delivering a flow of water over a surface of the chilled first mold portion that has a shaped cavity and over the surface of the second chilled mold portion that has a shaped cavity such that the flow of water passes along the surface of the first chilled mold portion having a shaped mold cavity and along the surface of the second chilled mold portion having a shaped mold cavity wicks along the contour of the mold surfaces having a shaped cavity and into the shaped mold cavity of the chilled first and second mold portions thereby gradually forming a shaped ice structure segment within the mold section of both the first mold portion and the second mold portion;

ceasing the flow of water when the first mold portion and the second mold portion contain the shaped ice structure segments;

fusing the shaped ice structure segments together by bringing them together and applying heat thereby forming a spherically shaped ice structure; and ejecting the spherically shaped ice structure from the mold.

* * * * *